US007232028B2

(12) United States Patent
Schulz

(10) Patent No.: US 7,232,028 B2
(45) Date of Patent: Jun. 19, 2007

(54) CLEANING UNIT FOR CLEANING TRAVEL EQUIPMENT, TRAVEL EQUIPMENT WITH A CLEANING UNIT AND METHOD FOR CARRYING OUT A CLEANING SEQUENCE FOR CLEANING TRAVEL EQUIPMENT

(75) Inventor: Robert Schulz, Vienna (AT)

(73) Assignee: Inventio AG, Hergiswil (CH)

( * ) Notice: Subject to any disclaimer, the term of this patent is extended or adjusted under 35 U.S.C. 154(b) by 13 days.

(21) Appl. No.: 10/977,856

(22) Filed: Oct. 29, 2004

(65) Prior Publication Data

US 2005/0091780 A1 May 5, 2005

(30) Foreign Application Priority Data

Oct. 30, 2003 (EP) ..... 03405779

(51) Int. Cl.
*B66B 31/00* (2006.01)

(52) U.S. Cl. ..... 198/493; 198/321; 198/326; 198/333; 198/494; 198/495; 198/496

(58) Field of Classification Search ..... 198/321, 198/326, 333, 493, 494, 495, 496
See application file for complete search history.

(56) References Cited

U.S. PATENT DOCUMENTS

| | | | | |
|---|---|---|---|---|
| 2,617,515 | A * | 11/1952 | Hohnecker | 198/332 |
| 2,634,850 | A * | 4/1953 | Hansen | 198/322 |
| 4,514,872 | A * | 5/1985 | Hopkins | 15/256.5 |
| 4,519,490 | A * | 5/1985 | White | 198/333 |
| 4,934,512 | A * | 6/1990 | Lin et al. | 198/495 |
| 5,025,527 | A * | 6/1991 | Armstrong | 15/256.5 |
| 5,042,641 | A | 8/1991 | Soldat | |
| 5,117,968 | A * | 6/1992 | Rivera | 198/496 |
| 5,236,075 | A * | 8/1993 | Bartmann | 198/323 |
| 5,560,468 | A * | 10/1996 | Inoue | 198/333 |
| 6,527,103 | B2 * | 3/2003 | Neszmerak | 198/496 |
| 6,543,599 | B2 * | 4/2003 | Jasinetzky | 198/333 |
| 2001/0025764 | A1 | 10/2001 | Neszmerak | |

FOREIGN PATENT DOCUMENTS

| | | |
|---|---|---|
| JP | 05319768 A | 12/1993 |
| JP | 08157176 A | 6/1996 |
| JP | 08225285 A | 9/1996 |

* cited by examiner

*Primary Examiner*—Douglas A. Hess
(74) *Attorney, Agent, or Firm*—Schweitzer Cornman Gross & Bondell LLP

(57) ABSTRACT

A cleaning unit for cleaning travel equipment allows the travel equipment to be shifted from an operating mode to a cleaning mode. The cleaning equipment is an escalator or a moving walkway which has tread units connected with an endless conveyor. The cleaning unit can be mounted as a substitute for a tread unit of the travel equipment during a cleaning sequence and includes cleaning elements. The travel equipment can be shifted from an operating mode to a cleaning mode in which the cleaning equipment is substituted for one or more tread units and the travel equipment operated whereby a cleaning sequence is performed. After cleaning is performed, the equipment is stopped, the cleaning equipment removed, and the removed treads reinstalled.

9 Claims, 2 Drawing Sheets

CLEANING UNIT FOR CLEANING TRAVEL EQUIPMENT, TRAVEL EQUIPMENT WITH A CLEANING UNIT AND METHOD FOR CARRYING OUT A CLEANING SEQUENCE FOR CLEANING TRAVEL EQUIPMENT

The invention relates to a cleaning unit for cleaning travel equipment in the form of an escalator or a moving walkway, to travel equipment which can be shifted from an operating mode to a cleaning mode and to a method for carrying out a cleaning sequence for cleaning travel equipment.

BACKGROUND OF THE INVENTION

Items of travel equipment in the sense of the present invention are escalators and moving walkways with a plurality of tread units connected with an endless conveyor. Users of the travel equipment stand on tread surfaces of the tread units or walk on the travel equipment in the same direction as the travel equipment themselves move.

In the case of escalators the tread units form escalator steps, termed 'steps' in the following, and in the case of moving walkways the tread units form moving walkway plates, termed 'plates' in the following. Escalators overcome, with a relatively large angle of inclination, large differences in height, such as entire storys. Moving walkways run horizontally or at a slight inclination, but generally with lower angles of inclination than escalators.

The tread units are, particularly in the case of poor weather, walked on by wet and dirty footwear. As a result, not only the tread surfaces of the tread units, but also laterally adjoining stationary parts of the travel equipment, are soiled. Additional sources of dirt are escaping or excessive lubricant by which certain parts of the travel equipment are lubricated, as well as abrasion materials of guide elements which run against one another during movement of the travel equipment. In order to keep the travel equipment functionally capable and safe and to increase its service life, as well as to avoid noise due to worn and contaminated parts of the travel equipment, it is therefore necessary to undertake sufficient cleaning measures.

Manual cleaning is not held in high regard by operators of travel equipment, since it is unpleasant and time consuming and has the consequence on each occasion of a very long interruption of operation.

Accordingly, cleaning systems have been developed by which it is sought to avoid these disadvantages.

JP-08157176-A describes a cleaning system for cleaning stationary parts of the travel equipment, which laterally adjoin the tread units. This system contains cleaning elements in the form of brush elements which are arranged below the tread surfaces in the lateral regions of a tread unit to be invisible for users and move together with the tread unit. The brush arrangements can for cleaning purposes, be temporarily adjusted laterally outwardly from rest positions to operative positions in which they wipe along the stationary regions of the travel equipment to be cleaned. The adjustment of the cleaning elements or brush arrangements takes place by remote control. It is regarded as an advantage of this cleaning system that the operation of the travel equipment does not have to be interrupted during the cleaning process. However, it is necessary from time to time to interrupt operation of the travel equipment in order to replace worn brush arrangements of the cleaning elements. The wear may be comparatively high, since the brush arrangements always wipe in the same direction along the surfaces to be cleaned. Moreover, the remote control for adjusting the cleaning elements or brush arrangements is relatively complicated and is disposed in the contaminated region of the travel equipment, and thus is susceptible to disturbance or damage.

US-2001/0025764-A1 discloses cleaning systems with cleaning elements in the form of cleaning modules or cleaning blocks, particularly of fibre-filled plastics materials, which during movement of the endless conveyor constantly scrape off or scrub off contaminants from soiled stationary surfaces. The cleaning elements can be provided with a so-termed cleaning medium, not a liquid or pasty cleaning agent, but a cover in the form of a brush structure. The cleaning elements are fastened laterally below a cleaning unit which, for cleaning purposes is mounted in place of guide elements. It is disadvantageous with this cleaning system in that the substantially rigid cleaning elements can leave scratch tracks at the surfaces to be cleaned and that the cleaning elements wear out quickly. This is the case, even if to a moderated degree, when the cleaning elements have a cleaning medium with a brush structure. Moreover, it has proved necessary to secondarily clean the cleaning elements themselves to a certain degree, for which purpose a brush arrangement can be provided. However, such thereby results in a comparatively complicated cleaning system.

It is therefore objects of the invention to create a cleaning unit of the kind stated in the introduction, by which the mentioned disadvantages are avoided and which cleans efficiently, is not susceptible to disturbance and has a high service life;

- to provide travel equipment which can be cleaned by such a cleaning unit; and
- to provide a method for carrying out a cleaning sequence for cleaning the travel equipment.

According to the invention the foregoing and other objects and purposes are met by a cleaning unit for travel equipment, and particularly escalators and moving walkways, in the form of a unit that can be mounted in place of a tread unit for a cleaning cycle or process and then demounted from the travel equipment and the conclusion of the cycle or process.

By a cleaning unit there is to be understood within the scope of the present description a step or plate, which is constructed for cleaning the travel equipment, including all its individual components even when these do not form a "unit" in the actual sense of the word.

According to the invention the new cleaning unit is not a step or plate permanently mounted in the endless conveyor of the escalator or moving walkway, but it is mounted as a substitute for a usual step or plate only temporarily for a cleaning sequence with respect to cleaning purposes. In this connection small or short mounting and demounting operations (approximately 2 to 5 minutes expenditure of time) do indeed occur for each cleaning process, but this small disadvantage is offset by the advantages of the invention. The most important advantages of the invention are to be seen in that

- a more efficient and complete cleaning can be undertaken by new cleaning units;
- the cleaning unit is not susceptible to disturbance and has a long service life, since it is not permanently in use;
- possible disturbances of the cleaning unit can be eliminated in a simple manner and worn cleaning elements can be replaced when the cleaning unit is not in use and is demounted, as a result a secondary cleaning of the cleaning elements during use is not needed;
- a single cleaning unit can be used in connection with a number of travel equipment units;

cleaning of stationary lateral walls, even in the visible region thereof can be accomplished, whereas with the previously known cleaning units in the case of escalators only a visible strip, narrow in height, could be cleaned and, moving walkways, no visible parts at all could be cleaned;

depending on the respective degree or kind of contamination, specifically acting cleaning units can be installed, which are suitable for, for example, removing dry dust or dirt containing lubricant or slush containing dispersed salt, wherein optionally a specifically acting cleaning agent or neutralisation agent, preferably in fluid form, can be added;

in the case of need further tread units can be temporarily replaced by cleaning units;

demounting of tread units, in a given case to clean, check or replacement can be accomplished; and cleaning performed in a cleaning mode of operation of the travel equipment allows the endless conveyor to be so moved that the cleaning is performed in an optimum manner, wherein the endless conveyor can be moved in a different manner with respect to speed and direction than in a normal operating mode.

Preferably the cleaning elements are constructed as brush arrangements which are arranged in side regions of a cleaning step unit in such a manner that during the cleaning process they project slightly beyond the lateral boundaries of the step units and contact the adjoining stationary walls in a cleaning manner. The cleaning elements can also be constructed as a sponge or a cloth. A washing train can also be formed: sponge, brush, cloth and drier. Cleaning elements in the form of brushes are subject to only slight wear. With suitable selection of the bristle material, bristle dimensions and pressing pressure, scratch tracks on the cleaned surfaces can be avoided and, in fact, will not result due either to the bristles themselves or due to foreign particles, since such are only lightly pressed against the surfaces or wiped along the surfaces by the brushes of the brush arrangements. Moreover, due to the resilient flexibility of the bristles it is not necessary to position the brushes with a high degree of accuracy.

Use may be made of brush arrangements with brushes which lie below a surface which corresponds to the tread surface of the tread units of the cleaning unit. The travel equipment can thereby in a given case also be used by the public while the cleaning unit is installed.

In order to also clean considerable visible regions of the stationary lateral walls of the travel equipment there can be used a brush arrangement which has brushes which lie above a surface which corresponds with the tread surface of the tread units of the cleaning unit. In this connection, however, the travel equipment should no longer be made available to the public without restriction, but it is still possible for operators to be able to stand on the surface.

A respective brush arrangement may be provided at both side regions of the cleaning step, and it has proved advantageous if each of the brush arrangements comprises at least one non-rotatably mounted brush and at least one rotatably mounted brush. The non-rotatably mounted brush can either be fixedly mounted or mounted for area vibration. The rotatably mounted brush, which is also termed a "roller brush", is generally set in rotation by a movement produced in the travel direction of the cleaning step. The two brushes are preferably detachably mounted, for example by means of bolt/nut connections.

The non-rotatably mounted brush can be fastened to a support body of the cleaning unit which in turn is mounted to a body of the cleaning unit, preferably detachably and by means of, for example, a further bolt/nut connection. The rotatably mounted brush, which can be constructed as a roller brush, is fastened to a roller shaft of the cleaning unit by means of, for example, a screw or bolt connection.

It is particularly favourable if a flowable cleaning agent, preferably a fluid, is fed to at least a part of the brushes continuously or at intervals in time. In this connection the flowable cleaning agent can be fed from a cleaning agent dispenser which co-moves solidly with the cleaning step. The feed of the cleaning agent is advantageously carried out automatically or by gravitational force. The fluid dispenser can be, depending on the respective arrangement of the brushes, a gravity dispenser or a pump dispenser, wherein the pump can have an approximate form of drive. It can be driven, for example, electrically, mechanically or chemically by combustion cells or by compressed air.

Travel equipment in the form of an escalator or moving walkway, with tread units which are connected to an endless conveyor, are usually disposed in an operating mode in which the endless conveyor is driven. For carrying out a cleaning sequence in accordance with the invention, the travel equipment is shifted to a cleaning mode, wherein the endless conveyor is stopped, at least one tread unit is replaced by at least one cleaning unit, the endless conveyor is driven again for the actual cleaning and subsequently the cleaning units are demounted and tread units remounted. The travel equipment can thereupon be shifted back to its operating mode.

BRIEF DESCRIPTION OF THE DRAWINGS

The invention is explicitly described in the following on the basis of examples and with reference to the drawing, in which.

DETAILED DESCRIPTION OF THE INVENTION

Figure 1:
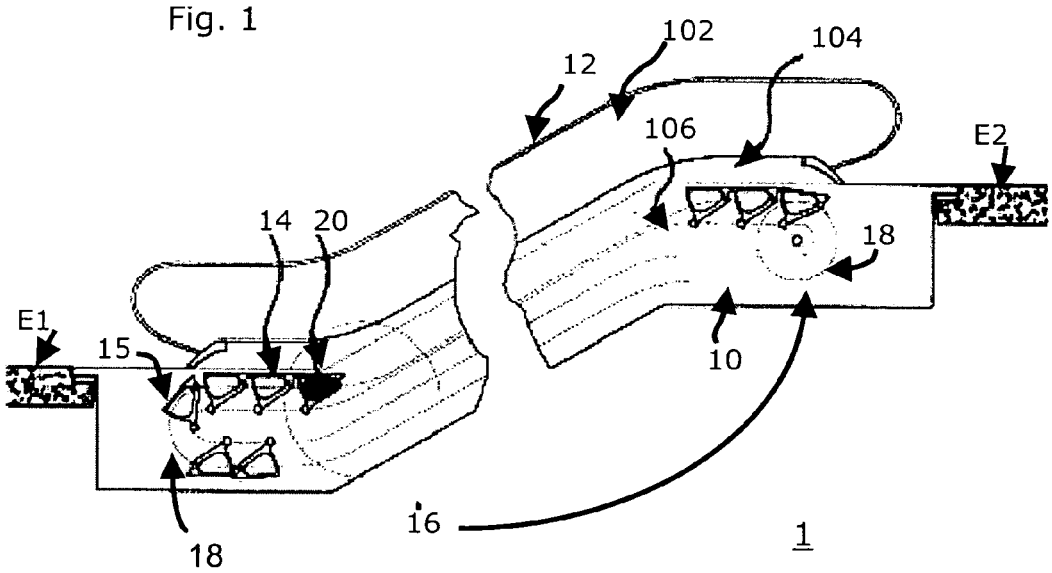
FIG. 1 is a partial sectional diagrammatic side view of travel equipment in the form of an escalator embodying the invention.

The travel equipment 1 illustrated in FIG. 1 is an escalator which connects a lower plane E1 with an upper plane E2. The travel equipment 1 has as visibly moved parts an endless conveyor 10 and an endless handrail 12, which are movable together.

The endless conveyor 10 substantially consists of a plurality of tread units 14 and the connecting elements connecting the tread elements 14, a drive 16 and two reversals 18. The tread units 14 is in the form of steps and have tread surfaces 15. The travel equipment 1 is illustrated in a configuration in which a tread unit 14 is demounted and replaced by a temporarily mounted cleaning unit 20. After conclusion of the cleaning process a tread unit 14 is remounted in place of the cleaning unit 20.

The cleaning unit 20 can also be so constructed that it can be mounted as a replacement for several adjacent tread units 14. Alternatively, several tread units can be each replaced by a respective cleaning unit.

The cleaning unit 20 is preferably so constructed that it can be fastened in the same known manner as the tread units 14 and are fastened to a step chain or other padless conveyor means.

The travel equipment 1 further comprises a plurality of stationary parts. Arranged at both sides of the tread units 14 are at least approximately vertical walls, of which only the wall 102 is shown in FIG. 1. Disposed at the lower region of the wall 102 is a base, the upright base plate 104 of which is arranged directly adjacent to the lateral boundaries of the tread units 14 and is separated from the tread units 14 by only a small gap. Stationary parts of the travel equipment 1 are, in addition, running tracks, of which only the running track 106 is shown in FIG. 1.

Figure 2:
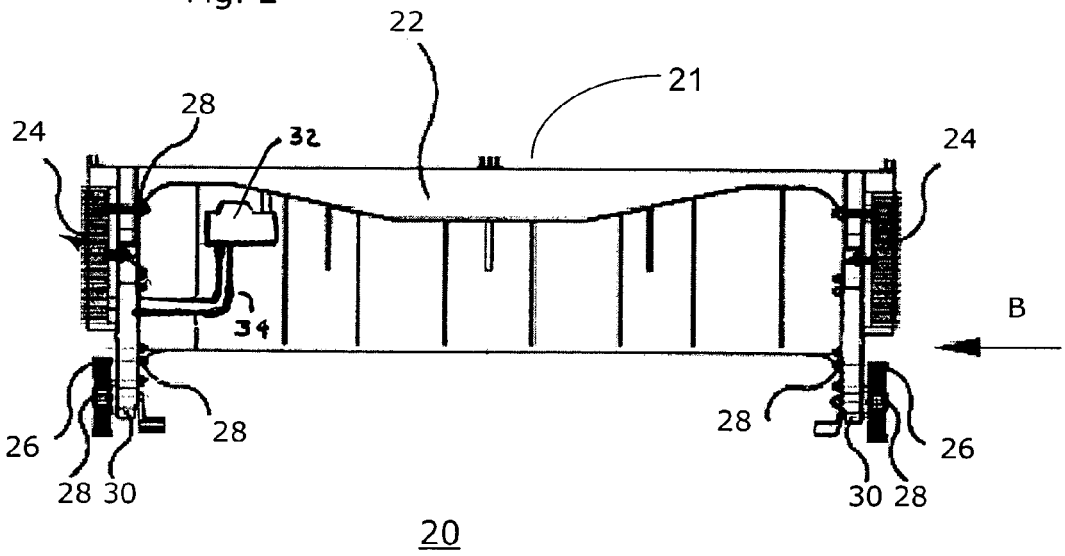
FIG. 2 is an end elevation view of a cleaning unit for the travel equipment illustrated in FIG. 1 above.

FIG. 2 shows a step-like cleaning unit 20. This cleaning unit 20 has a surface 21 which corresponds to the tread surfaces 15 of the tread units 14. The cleaning unit 20 further comprises a body 22. The cleaning unit 20 has two brush arrangements arranged in mirror symmetry. Each brush arrangement has a first cleaning element 24 and a second cleaning element 26. A dispenser 32 may be mounted to the body 22, and carries a liquid cleaning agent which is led through line 34 to cleaning element 24. The dispenser may be either gravity-operated, or may include a pump, with our without appropriate timing means, to drive the fluid to a cleaning element. Either or both of the cleaning elements 24, 26 on either or both sides of the cleaning element 20 may be provided with cleaning agent from one or more dispensers 32.

Figure 3:
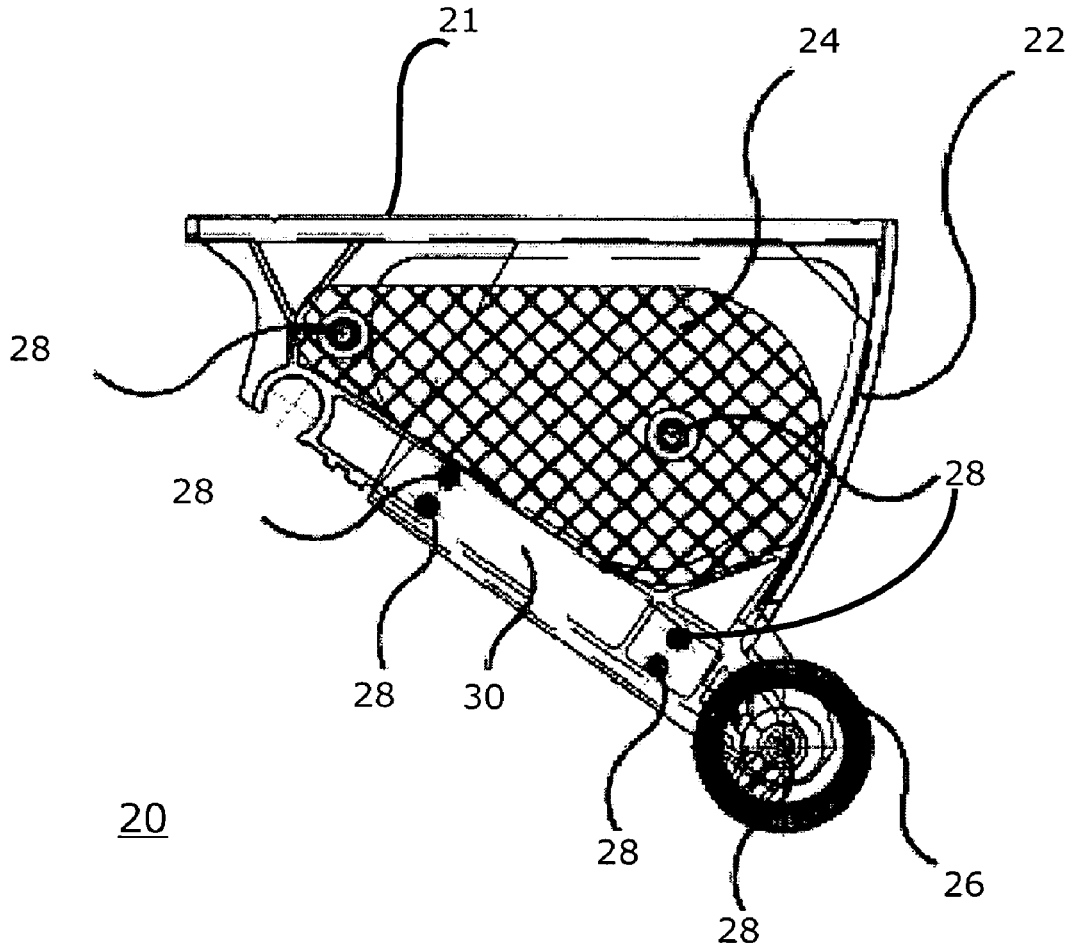
FIG. 3 is a side elevation view of the cleaning unit illustrated in FIG. 2, from the direction according to the arrow B in FIG. 2.

FIG. 3 shows the cleaning unit illustrated in FIG. 2, in a view according to the arrow B. The first cleaning element 24 is a fixedly-mounted brush with bristles, the outer ends of which all lie approximately in a flat, relatively large effective area which is illustrated in FIG. 3 by cross-checked hatching. One or more of a sponge or cloth agent may also be utilized as part of the cleaning element. This cleaning element 24 is detachably fastened in a destruction-free manner to a fastening body 30, which is shown constructed as a support plate, by means of bolt/nut connections 28. The fastening body 30 in turn is similarly detachably fastened in a destruction-free manner to the body 22 by means of further bolt/nut connections 28. The fastening can also be effected in another suitable form; fastening systems which are detachable without a tool, but are nevertheless secure, being particularly suitable. The cleaning element 24 serves for cleaning the base plate 104. In the case of use of conventional sliding block guides better guidance of the tread units 14 thereby results.

The second cleaning element 26 is a rotatably-mounted brush which may also be termed a "roller brush". This cleaning unit 26 usually does not have its own drive, but is set in rotation by the movement of the cleaning step in the travel direction of the endless conveyor. The second cleaning element 26 is fastened to a roller shaft, in place of the conventional plastics material roller of the tread units 14, by means of an additional bolt/nut connection 28. The cleaning element 26 serves for cleaning the running track 106. The roller brush may be an actual brush, a sponger or cloth, or a combination thereof.

The travel equipment 1 is usually disposed in an operating mode in which the endless conveyor 10 is driven either permanently or in case of need, i.e. when a user is present. For carrying out a cleaning sequence the travel equipment 1 is shifted into a cleaning mode. In the cleaning mode the endless conveyor 10 is stopped, at least one cleaning unit 20 is mounted as a substitute for at least one tread unit 14, the endless conveyor is set in operation for the actual cleaning and, after the actual cleaning operation is stopped, the cleaning units 20 are demounted and the tread units 14 remounted. Subsequently the travel equipment is shifted back into the operating mode.

For the actual cleaning, the travel equipment 1 or the endless conveyor 10 is preferably so operated that the cleaning unit 20 with its upper surface 21 in an upper position is moved downwardly. Depending on the respective contamination, the cleaning step 20 can in this connection be run once or several times from the upper plane E2 to the lower plane E1.

The changeover of the travel equipment from an operating mode to a cleaning mode makes it possible for the endless conveyor to be able to be driven at the same speed as or at different speeds from that usual in operating mode, for example quicker or slower, going jerkily or back and forth or moving upwardly and downwardly.

I claim:

1. A cleaning unit for cleaning travel equipment having tread units connected with an endless conveyor, the cleaning unit being dimensioned and adapted to be mounted in place of at least one tread unit and comprising a body and cleaning elements mounted to the body for cleaning regions of the travel equipment adjoining the tread units during movement of the endless conveyor, and further characterized in that the cleaning unit can be mounted as a substitute for at least one of the tread units and can be demounted again after conclusion of the cleaning process, the cleaning elements being constructed as a brush arrangement having brushes which are arranged above a surface which corresponds to the tread surface of the tread units to clean at least lower regions of visible lateral walls of the travel equipment.

2. The cleaning unit according to claim 1 characterized in that the brush arrangement comprises at least one or a fixedly mounted brush or a rotatably mounted brush.

3. The cleaning unit according to claim 2 wherein the rotatably mounted brush include means for rotating the brush by a cleaning unit movement produced in a travel direction of the cleaning unit.

4. The cleaning unit according to claim 2, wherein the fixedly mounted brush is detachably fastened to a support body of the endless conveyor, and the support body is mounted on a body of the cleaning unit.

5. The cleaning unit according to claim 2, wherein the rotatably mounted brush is constructed as a roller brush and is detachably fastened to a roller shaft of the cleaning unit.

6. The cleaning unit according to claim 2, further comprising a cleaning agent dispenser coupled to the cleaning unit for dispensing a flowable cleaning agent to at least a part of the cleaning elements.

7. The cleaning unit according to claim 6, wherein the cleaning agent dispenser is a gravity dispenser or a pump dispenser.

8. Travel equipment in the form of an escalator or a moving walkway, with tread units connected with an endless conveyor, characterized in that at least one of the tread units can be temporarily demounted for cleaning purposes and replaced by a cleaning unit according to claim 1, the travel equipment having means for entering into a cleaning mode to move the cleaning unit into an orientation with a surface which corresponds to the tread surface of the tread units arranged at a top of the travel equipment.

9. A method of carrying out a cleaning sequence for cleaning travel equipment in the form of an escalator or a moving walkway with tread units connected with an endless conveyor, wherein the cleaning is carried out with the help of a cleaning unit, characterized in that the cleaning equipment is shifted from an operating mode to a cleaning mode in which the endless conveyor is stopped, at least one of the tread units is demounted, at least one cleaning unit according to one of claims 1 to 4 is mounted as a substitute for at least a part of the demounted tread units, the endless conveyor is set in operation for the actual cleaning and is subsequently stopped, each cleaning unit is demounted, and a corresponding number of tread units are remounted again, and the travel equipment is returned to the operating mode.

* * * * *